US008701251B2

(12) United States Patent
Bohn

(10) Patent No.: US 8,701,251 B2
(45) Date of Patent: Apr. 22, 2014

(54) HINGE FOR A DOOR OF A MOTOR VEHICLE

(75) Inventor: Martin Bohn, Grafenau (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 13/635,128

(22) PCT Filed: Dec. 18, 2010

(86) PCT No.: PCT/EP2010/007779
§ 371 (c)(1),
(2), (4) Date: Oct. 19, 2012

(87) PCT Pub. No.: WO2011/113466
PCT Pub. Date: Sep. 22, 2011

(65) Prior Publication Data

US 2013/0047378 A1 Feb. 28, 2013

(30) Foreign Application Priority Data

Mar. 16, 2010 (DE) ..... 10 2010 011 628

(51) Int. Cl.
*E05C 17/64* (2006.01)
*E05D 7/086* (2006.01)

(52) U.S. Cl.
USPC ..... 16/342

(58) Field of Classification Search
USPC ..... 16/337, 338, 339, 340, 341, 342, 82, 16/83, 349, 235, 239, 247
See application file for complete search history.

(56) References Cited

U.S. PATENT DOCUMENTS

| | | | | |
|---|---|---|---|---|
| 2,872,697 | A * | 2/1959 | Hizsa, Jr. | 16/342 |
| 3,237,239 | A * | 3/1966 | Rudnick | 16/335 |
| 5,598,607 | A * | 2/1997 | Katagiri | 16/337 |
| 5,682,645 | A * | 11/1997 | Watabe et al. | 16/338 |
| 6,470,532 | B2 * | 10/2002 | Rude | 16/335 |
| 6,473,937 | B1 | 11/2002 | Morawetz | |
| 6,553,625 | B2 * | 4/2003 | Lin et al. | 16/342 |
| 6,584,646 | B2 * | 7/2003 | Fujita | 16/342 |
| 6,609,272 | B1 * | 8/2003 | Lee | 16/307 |
| 6,739,020 | B1 * | 5/2004 | Morawetz | 16/334 |
| 6,928,700 | B2 * | 8/2005 | Huong | 16/342 |

(Continued)

FOREIGN PATENT DOCUMENTS

| | | |
|---|---|---|
| DE | 198 17 699 A1 | 11/1999 |
| DE | 10 2005 008 214 B3 | 3/2006 |

OTHER PUBLICATIONS

International Search Report with English translation dated Apr. 6, 2011.
Form PCT/ISA/237.

*Primary Examiner* — Jeffrey O Brien
(74) *Attorney, Agent, or Firm* — Crowell & Moring LLP

(57) ABSTRACT

A hinge for a door, flap or similar pivotal wings of a motor vehicle is provided. The hinge includes a column-side hinge part and a door-side hinge part, which can be pivoted about a hinge pillar relative to each other, and with an integrated door retaining device, which includes a retaining element arranged on the side of the one hinge part, which cooperates with a retaining contour on the side of the other hinge part. The retaining element is formed as clamp element cooperating with a clamping surface of the hinge pillar, the clamping force of which can be adjusted by means of a transmission element as a function of the retaining contour.

9 Claims, 2 Drawing Sheets

(56) References Cited

U.S. PATENT DOCUMENTS

Figure 1:
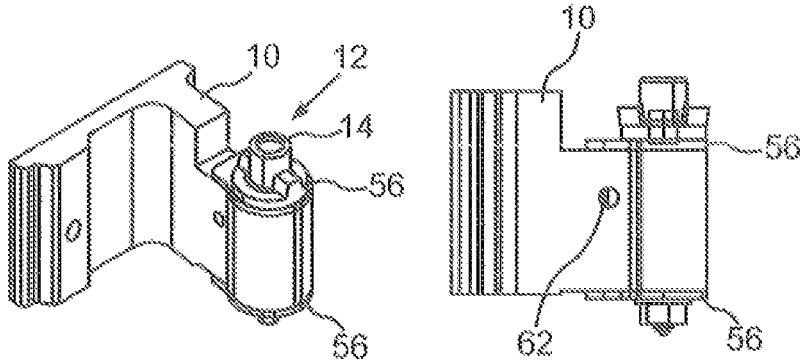

| | | | | |
|---|---|---|---|---|
| 7,188,390 | B2 * | 3/2007 | Cheng | 16/252 |
| 7,275,286 | B2 * | 10/2007 | Lu et al. | 16/340 |
| 8,074,322 | B2 * | 12/2011 | Wang et al. | 16/342 |
| 8,091,179 | B2 * | 1/2012 | Wang et al. | 16/342 |
| 8,104,823 | B2 * | 1/2012 | Kohlstrand | 16/82 |
| 8,108,969 | B2 * | 2/2012 | Ochiai | 16/334 |
| 8,196,263 | B2 * | 6/2012 | Wang et al. | 16/338 |
| 8,201,305 | B2 * | 6/2012 | Brouwer et al. | 16/354 |
| 8,510,914 | B2 * | 8/2013 | Minegishi | 16/334 |
| 2001/0016969 | A1 * | 8/2001 | Fujita | 16/342 |
| 2002/0073508 | A1 * | 6/2002 | Rude | 16/341 |
| 2004/0134033 | A1 * | 7/2004 | Raines et al. | 16/342 |
| 2005/0102796 | A1 * | 5/2005 | Lee et al. | 16/342 |
| 2006/0272128 | A1 * | 12/2006 | Rude | 16/342 |
| 2007/0157433 | A1 * | 7/2007 | Lu et al. | 16/342 |
| 2007/0214605 | A1 * | 9/2007 | Tu | 16/342 |
| 2010/0064475 | A1 * | 3/2010 | Wang et al. | 16/232 |
| 2011/0016669 | A1 * | 1/2011 | Shen | 16/342 |
| 2011/0072620 | A1 * | 3/2011 | Wang et al. | 16/342 |
| 2011/0099761 | A1 * | 5/2011 | Wang et al. | 16/339 |
| 2011/0173776 | A1 * | 7/2011 | Lee | 16/342 |
| 2012/0246875 | A1 * | 10/2012 | Lowen | 16/337 |

* cited by examiner

HINGE FOR A DOOR OF A MOTOR VEHICLE

BACKGROUND AND SUMMARY OF THE INVENTION

The invention relates to a hinge for a door, flap or similar pivotal wings of a motor vehicle.

German Patent DE 198 17 699 A1 discloses such a hinge, which comprises a column-sided as well as a door-sided hinge part, which are pivotal about a hinge pillar relative to each other. In this case the hinge comprises an integrated door retaining device, which on the side of the one—in this case column-sided hinge part includes a retaining element in the form of a braking- and retaining body, which cooperates with a retaining contour on the side of the other hinge part—in this case on the side of the hinge pillar connected to the other hinge part. The retaining contour in this case has a continuously upwards contour gradient in the way of a brake ramp.

In such friction-based door retaining devices very high surface pressures can arise on the friction pairings due to linear contact. These drastically limit the choice of material and are prone to wear. As the result of a very high spring rate the lift movements on the friction pairing are very short. On the one hand this causes very high tolerance requirements in the production process and on the other hand also does not allow any precise control by means of the retaining contour.

Exemplary embodiments of the present invention are directed to a hinge that can be constructed more simply and more compactly and in addition comprises a far less tolerance-sensitive door retaining device.

In order to create a hinge of the type defined initially, which can be constructed in an extremely space saving manner and whose door retaining device is less tolerance-sensitive, the retaining element is formed as clamp element cooperating with a clamp surface of the hinge pillar, the clamping force of which is adjustable via a transmission element as a function of the retaining contour. In other words, according to the invention a clamp element cooperates preferably with the outer circumference side of the hinge pillar. This clamp element at the same time can, for example, embrace, in particular encircle, the hinge pillar, whereby the clamping force exerted by the clamp element on the hinge pillar can be varied by means of the transmission element. The clamping force varies in this case as a function of the retaining contour, which cooperates with one end, turned away from the clamp element, of the transmission element.

The present embodiment of the door retaining device with the clamp element in this case has the advantage that the hinge can be formed in an extremely space saving manner. Such a clamp element, namely with minimum space requirement, can generate a substantial clamping force, in order for example to brake or completely prevent the counter-acting pivotal movement of the hinge parts.

By using a transmission element, which cooperates with the retaining contour, in addition a corresponding force ratio can be achieved, so that relatively large braking- or retaining forces of the door retaining device can be obtained with extremely minimum space requirement.

In a further embodiment of the invention it has proven advantageous if the clamp element embraces the hinge pillar in a tube region the cross-section of which is circular ring segment shaped within an angle range of >180°. Thus, contact can be established with the corresponding clamping area of the hinge pillar by reducing the inner diameter of this tube region, wherein the clamping or retaining force that is applied on the hinge pillars, can be increased or reduced depending upon the adjustment of the inner diameter by means of the transmission element. As a result the force or torque transmitted between the two hinge sections can be adjusted in a particularly advantageous way.

The retaining contour of the door retaining device is preferably provided on the hinge pillar itself. In particular it has proven advantageous if the retaining contour is provided on a separate contour element non-rotatably connected to the hinge pillar. Thus, the rotation of the hinge pillar or the associated hinge part corresponds to the rotation of the retaining contour, which for its part via the transmission element controls the clamping force of the clamp element acting on the hinge pillar.

A further preferred embodiment involves designing the connecting element between the retaining contour and clamp element as transmission lever. Such a transmission lever has the advantage that relatively high clamping forces can be generated. This is in particular achievable in a further embodiment of the invention by the fact that a lever arm, facing the retaining contour, of the transmission lever is longer than a lever arm facing the clamp element. This has the advantage that relatively minimum friction forces occur between the components in friction contact—the retaining contour and the corresponding lever arm, whereas on the side of the clamp element relatively large forces can be generated via the longer lever arm of the transmission element.

In a further preferred embodiment the clamp element is connected non-rotatably to one hinge part and the retaining contour non-rotatably to the other hinge part, in particular with the hinge pillar. As a result particularly simple control of the door retaining device is achieved.

In a further preferred embodiment a pillar opening, receiving the hinge pillar, of the corresponding hinge pillar is formed as opening increased in the cross-sectional area relative to the hinge pillar, which is sealed by means of a respective cap on both opening sides. The pillar opening or continuous opening increased relative to the hinge pillar in this case has the advantage that the door retaining device can be introduced along the hinge axis from above or below the corresponding hinge part, which signifies a substantial simplification of assembly. A further advantage of the increased size of the pillar or continuous opening relative to the hinge pillar consists in the fact that the position of the hinge axis can be selected within certain limits. This results in greater freedom in the design of the hinge.

In a simple way in this case the pillar opening formed as continuous opening can be sealed by caps, attached respectively on the upper or lower side, wherein on the one hand the caps serve to protect the door retaining device and on the other hand define the position of the hinge axis.

A further advantage is that such a continuous opening is simpler to produce so that individual hinge parts can also be made, for example, from semi-finished products. This results in a substantially simpler structure of the hinge with integrated door retaining device as well as more simple assembly is likewise possible.

It has proven advantageous in a further embodiment of the invention if both caps are formed separately from the hinge pillar. Thus, the pillar opening is accessible from both sides and the position of the hinge axis can be selected in an especially advantageous manner.

In a further advantageous embodiment the door retaining device is at least generally arranged within the pillar opening. Thus, not only a particularly space saving hinge can be produced but in addition the door retaining device is arranged so as to be particularly protected.

BRIEF DESCRIPTION OF THE DRAWING FIGURES

Figure 2:
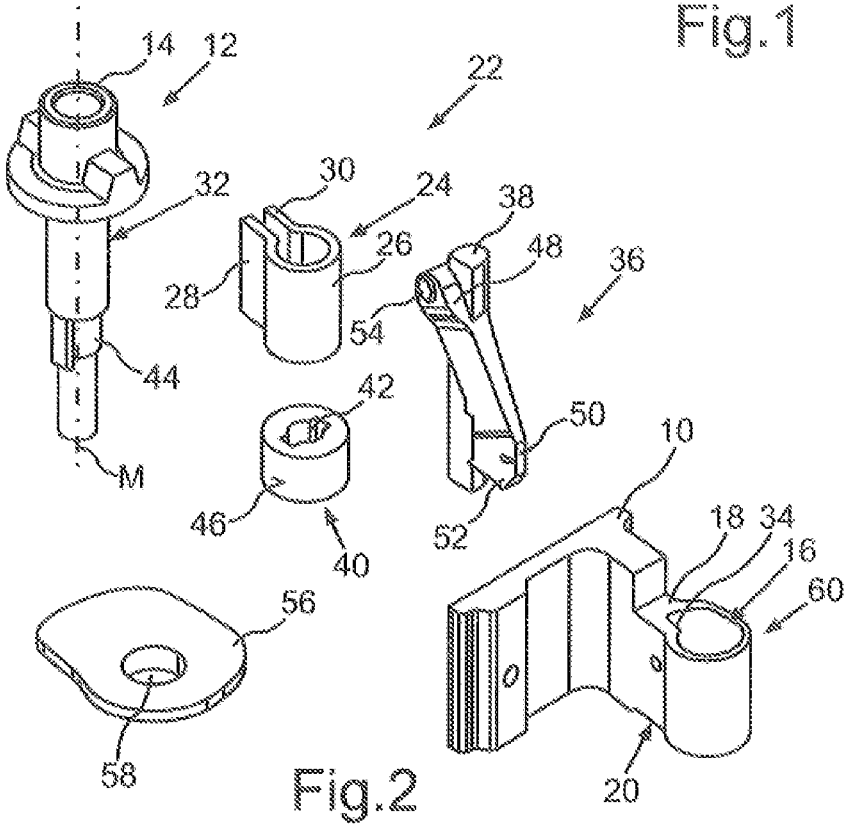
Figure 3:
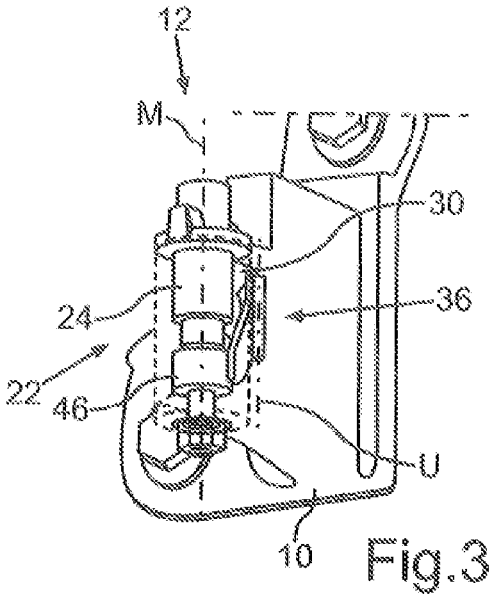
Figure 4:
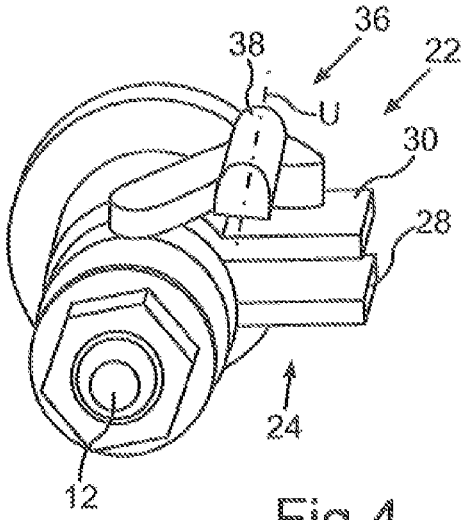

Further advantages, features and particulars of the invention will be clear from the following description of preferred exemplary embodiments as well as by reference to the drawings; wherein:

FIG. 1 shows a perspective view as well as a side view onto a hinge for a door of a passenger vehicle with a column-sided hinge part and with a hinge pillar associated to a door-sided hinge part, about which the hinge parts are pivotal relative to each other, and with an integrated door retaining device, which is arranged within a pillar opening, receiving the hinge pillar, of the column-sided hinge part, wherein the cross-sectional size of the pillar opening, which in the present case is sealed by means of a respective cap on both sides of the opening, is thus increased relative to the hinge pillar;

FIG. 2 shows an exploded illustration of the hinge in accordance with FIG. 1, wherein apart from the column-sided hinge part and the hinge pillar in particular a clamp element cooperating with a clamping surface of the hinge pillar is evident, the clamping force of which is adjustable via a transmission element in the form of a transmission lever as a function of a retaining contour, the retaining contour being provided on a separate, disk-like element non-rotatably connected to the hinge pillar and additionally one of the two caps for sealing the continuous opening being illustrated;

FIG. 3 shows a perspective view of the hinge with the door retaining device in a slightly modified embodiment; and FIG. 4 shows a perspective lower view of the door retaining device of the hinge, wherein particularly the hinge pillar, the clamp element cooperating with the clamping surface of the hinge pillar as well as the transmission element in the form of the transmission lever, which is adjustable as a function of the retaining contour of the disk-shaped contour element, are evident.

DETAILED DESCRIPTION

In FIG. 1 a hinge for a side door of a passenger vehicle is illustrated in a perspective view as well as a side view. The present hinge in principle can also be used for a flap or another pivotal wing in the vehicle structure. In accordance with FIG. 2 this hinge is shown in an exploded illustration.

As is evident from FIGS. 1 and 2, the hinge first comprises a column-sided hinge part 10, which receives a hinge pillar 12 in the way described in more detail below. The hinge pillar 12 in turn is non-rotatably connected to a not illustrated door-sided hinge part, which, for example, can be placed from above onto a head 14. Therefore, the column-sided hinge part 10 and the door-sided hinge part are pivotal about the hinge pillar 12 relative to each other.

As now evident from FIG. 2, the column-sided hinge part 10 comprises a pillar opening 16, the cross-sectional size of which is increased relative to the hinge pillar 12 and is formed as continuous opening. In other words, the pillar opening 16 is open both at an upper side 18 as well as at a lower side 20 of the column-sided hinge part 10.

The cross-sectional size of the pillar opening 16 is therefore increased relative to the hinge pillar 12, because an integrated door retaining device 22 is provided, which in conjunction with FIGS. 3 and 4 is evident in more detail. For this purpose FIG. 3 shows a perspective view onto the hinge, which however is somewhat modified. FIG. 4 in a further perspective view shows the main components of the door retaining device 22.

The door retaining device 22 apart from the hinge pillar 12 first comprises a clamp element 24, which includes a cross-sectional circular ring segment shaped tube region 26 as well as two adjoining shanks 28, 30. The inner diameter of the tube region 26 of clamp element 24 in this case is adapted to an outer diameter of the hinge pillar 12 in the vicinity of a clamping surface 32. In other words a braking- or retaining force, which brakes or completely prevents a movement of the hinge pillar 12, can be generated due to the fact that the two shanks 28, 30 are moved towards one another. As a result the inner diameter of the tube region 26 is reduced, and thus a force- or frictional engagement with the corresponding clamping surface 32 of the hinge pillar 12 is achieved.

In the installed state the shank 28 rests on a counter surface 34 of the pillar opening 16. In other words, the shank 28 thus always remains stationary.

The opposite-lying shank 30 can, however, be moved to a greater or lesser degree away from or nearer to the shank 28, in order to adjust the braking- or retaining force for the hinge pillar 12 or the door-sided hinge part.

This takes place in the present case via a transmission element 36 in the form of a transmission lever, which is likewise received within the pillar opening 16. The arrangement of the transmission lever 36 in this case is particularly evident from FIGS. 3 and 4, it being particularly clear from FIG. 3 that the transmission lever 36 is mounted pivotally on the column-sided hinge part 10 about a lever axis 38 running in the vehicle vertical direction with the geometrical axis U. The axis U or the lever axis 38 runs in this case in the extension direction of the pillar opening 16 or in the vehicle vertical direction.

Moreover, a contour element 40 in the form of a disk is particularly evident from FIG. 2, which comprises a non-rotationally symmetrical or off-center middle opening 42, through which the contour element 40 can be stuck onto a complementary formed area 44 of the hinge pillar 12. The contour element 40 is therefore non-rotatably connected to the hinge pillar 12. In particular, the contour element 40 in this case comprises a retaining contour 46 on its outer circumference, the object of which will be described in more detail below. It should be recognized that the present invention can also involve providing the retaining contour 46 directly on the hinge pillar 12.

As now moreover evident from FIGS. 2 to 4, the transmission element in the form of the transmission lever 36 on either side of its axis U comprises a respective lever arm 48 or 50. The two lever arms 48, 50 in this case have different lengths. The longer lever arm 50 faces the retaining contour 46 of the contour element 40, while the shorter lever arm 48 faces the shank 30 of the clamp element 24. The long lever arm 50 is in sliding contact via a sliding cam 52 with the retaining contour 46 of the contour element 40. A cam 54, which is pressed against the shank 30 of the clamp element 24, is likewise provided on the shorter lever arm 52.

As now evident in particular from FIGS. 3 and 4, when the door and the hinge are opened or closed an accompanying rotational movement of the hinge pillar 12 relative to the column-sided hinge part 10 leads to the fact that the sliding cam 52 of the transmission lever 36 slides along the retaining contour 46 of the contour element 40. Since the retaining contour 46 comprises a contour gradient with variable radii to the central axis M of the hinge pillar 12, sliding of the sliding cam 52 along the retaining contour 46 leads to a pivotal movement of the transmission lever 36. This pivotal movement of the transmission lever 36 again leads to the fact that the shank 30 is moved relative to the stationary shank 28 of clamp element 24, as a result of which the clamping force between the tube region 26 and the clamping surface 32 of the hinge pillar 12 can be varied. In consequence of the rotational movement of the hinge pillar 12 via the retaining contour 46 and the transmission lever 36 a different clamping force is generated by means of the clamp element 24, which influences the pivotal movement of the hinge. Depending upon the adjusted clamping force the hinge moves easily or stiffly. With particularly high clamping force the hinge pillar 12 or the door-sided hinge part also moves stiffly in relation to the column-sided hinge part 10 as a result. With minimum or no clamping force there cannot be any frictional force between the tube region 26 and the corresponding clamping surface 32 of the hinge pillar 12.

All in all a door retaining device 22 is therefore created, by means of which the opening pivotal movement of the hinge parts 10 or the door can be adjusted. The clamping force in this case is adjusted via the transmission element 36 as a function of the retaining contour 46. Naturally, in a simple manner the clamping force can be adjusted door-specifically due the fact that a specific retaining contour 46 is produced. For this purpose only the contour element 40 must be selected door-specifically. Altogether it is also clear that the function of generating the retaining torque is separate from the opening angle-dependent control of the retaining torque. The one function results namely due to the retaining contour 46, the other function due to the clamp element 24.

Further it is evident that the friction pairing results due to partial encircling of the hinge pillar 12, which leads to significantly lower surface pressure. Particularly from FIG. 2 it is evident that the tube region 26 within an angular range of >180° embraces the hinge pillar 12 within the vicinity of the clamping surface 32. By selecting suitable lever lengths of the lever arms 48, 50 the clamping force of the clamp element 24 to be generated can be adjusted in a simple manner. Thus, the contour element 40 can be contoured substantially more strongly and more steeply by the lever ratio. Optionally, the axis U of the transmission lever 36 can be variably configured in order to adjust the level of the retaining torque. The contact surface between contour element 40 and transmission lever 36 can be substantially increased by separating the functions, as a result of which the size of the hinge can be reduced. Substantially more succinct surface feel contours can be produced as a result of the lever ratio. Also this system is less tolerance-sensitive.

As moreover evident in particular from FIG. 1, the cross-sectional size of the pillar opening 16 increased relative to the hinge pillar 12 on the upper side and on the lower side—i.e., on either side of the pillar opening 16—is sealed by means of a respective cap 56. Each of the two caps 56 in this case comprises a bearing opening 58, which determines the position of the central axis M of the hinge pillar 12 relative to the column-sided hinge part 10. The formation of the pillar opening 16 as continuous opening has the advantage that the door retaining device 22 can be introduced along the hinge axis M from above or below into the corresponding hinge part 10. This makes assembly substantially easier.

A further advantage of the continuous pillar opening 16 is that this can comprise a uniform cross-section and therefore, at least in a hinge region 60 comprising the pillar opening 16, can be formed from a semi-finished profile especially an extruded profile or rolled profile already provided with an opening. The space for the door retaining device 22 can therefore be already available in the semi-finished profile, wherein possibly minor, for example metal shaving, re-work is required. Thus, the production cost is significantly reduced in comparison to the concepts of today. In a particularly advantageous embodiment not only the hinge region 60, but the total hinge part 10, can be produced from a corresponding extruded or rolled profile or the like.

Since the two caps 56 are formed separately, this has the further advantage that as a result of these the position of the central axis M of the hinge can be adjusted relative to the respective hinge pillar 10.

Finally yet another maintenance opening 62 is evident particularly from FIG. 1. This can serve e.g. for lubrication or however for adjusting the door retaining device 22.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A hinge for a door, flap or pivotal wing of a motor vehicle, the hinge comprising:

a hinge pillar;

a column-side hinge part;

a door-side hinge part, wherein the column-side hinge part and the door-side hinge part are configured to be pivoted relative to each other about the hinge pillar; and an integrated door retaining device comprising a clamp element surrounding a clamping surface of the hinge pillar, a contour element having a retaining contour surface non-rotatably connected to said hinge pillar, and a transmission element, the transmission element has a first lever arm engaging the retaining contour surface and a second lever arm engaging the clamp element;

wherein as the hinge pillar rotates with respect to the column-side hinge part, the retaining contour surface engaging the first lever arm causes the second lever arm to engage the clamp element, a clamping force of the clamp element on the clamping surface of the hinge pillar is variable as a function of the retaining contour surface.

2. The hinge according to claim 1, wherein the clamp element embraces the hinge pillar in a cross-sectional circular ring segment shaped tube region within an angular range of greater than 180°.

3. The hinge according to claim 1, wherein the contour element is integrally provided on the hinge pillar.

4. The hinge according to claim 1, wherein the contour element is provided as a separate member.

5. The hinge according to claim 1, wherein the first lever arm is longer than the second lever arm.

6. The hinge according to claim 1, wherein the clamp element is non-rotatably connected to the column-side hinge part.

7. The hinge according to claim 1, wherein a pillar opening of one of the column-side hinge part and the door-side hinge part is configured to receive the hinge pillar, the pillar opening is a continuous opening, a cross-sectional size of which is increased relative to the hinge pillar, and is sealed on each side by a pair of respective caps.

8. The hinge according to claim 7, wherein the respective caps are formed separately from the hinge pillar.

9. The hinge according to claim 7, wherein the integrated door retaining device is arranged within the pillar opening.

* * * * *